United States Patent [19]

Lindberg

[11] Patent Number: 4,580,354

[45] Date of Patent: Apr. 8, 1986

[54] METHOD AND DEVICE FOR MEASURING HUMIDITY

[75] Inventor: Hans Lindberg, Gagnef, Sweden

[73] Assignee: Stora Kopparbergs Bergslags AB, Falun, Sweden

[21] Appl. No.: 609,668

[22] Filed: May 14, 1984

[30] Foreign Application Priority Data

May 18, 1983 [SE] Sweden ..... 8302790

[51] Int. Cl.[4] ..... F26B 21/06

[52] U.S. Cl. ..... 34/26; 34/43; 34/46; 34/50; 34/89; 73/335

[58] Field of Search ..... 73/335; 34/89, 50, 46, 34/54, 30, 29, 47, 26, 43

[56] References Cited

U.S. PATENT DOCUMENTS 4,221,058 9/1980 Zagorzycki ..... 34/89

4,276,128 6/1981 Nishino et al. ..... 73/335

*Primary Examiner*—Larry I. Schwartz

*Attorney, Agent, or Firm*—Fleit, Jacobson, Cohn & Price

[57] ABSTRACT

For determining the relative humidity of a highly moist gas, particularly air exiting from a wood-drying apparatus, there is used a humidity sensing arrangement having a capacitive sensor, whose capacitance varies with changes in the relative humidity of gas to which it is exposed, and means for generating an output signal proportional to the prevailing capacitance of said capacitive sensor. The capacitive sensor is exposed to a heated partial flow of the highly moist gas, and the output signal of the output signal generating means is modified in correspondence with the extent to which the partial flow has been heated.

5 Claims, 2 Drawing Figures

METHOD AND DEVICE FOR MEASURING HUMIDITY

The present invention relates to a method for use when determining the relative humidity of a highly moist gas, particularly air exiting from a wood-drying apparatus, in which method there is used a humidity sensing arrangement having a capacitive sensor which is exposed to the gas and the capacitance of which varies with changes in the relative humidity of said gas, and further having means for generating an output signal proportional to the prevailing capacitance of said capacitive sensor. The invention also relates to a device for carrying out the method.

The most usual method of determining the relative humidity of air is based on measuring the dry and wet temperature. The wet thermometer may be arranged, for example, in a porous ceramic tube placed under an internal water pressure (e.g. 2 m water column) in order to keep the tube moist. The ceramic tube, however, often exhibits excessively high blocking or clogging tendencies, which results in an increase in the measured wet temperature and therewith in an illusory increase in the relative humidity, which influences control means steered by the relative humidity, resulting in control errors, such that in the case of so-called progressive timber kilns, the wood is dried more rapidly than is desirable, resulting in over-drying of the wood. Over-drying of the wood implies excessively high specific energy consumption and impairs the quality of the wood. Consequently, a more reliable method of continuously evaluating the relative humidity of the air is greatly desired within, inter alia, wood-drying techniques. In recent times, relative humidity has been measured with the aid of so-called capacitive sensors. A capacitive sensor may comprise a moisture sensitive plastic foil placed between electrodes, the capacitance of the foil varying as a function of the relative humidity of the gas to which said foil is exposed. One disadvantage with capacitive sensors, however, is that they cannot be used satisfactorily at excessively high moisture contents.

The object of the present invention is to provide a novel and improved method for use when measuring the relative humidity of a highly moist gas.

To this end, it is proposed that the method according to the invention further comprises the steps of defining a partial flow of said gas; heating said partial flow; exposing the capacitive sensor to said heated partial flow; and modifying the output signal of said output signal generating means in correspondence with the extent to which said partial flow has been heated. This affords a high degree of reliability in operation with the use of inexpensive apparatus components, while ensuring, at the same time, a high degree of accuracy, as a result of the lower relative humidity of the gas in said partial flow caused by heating and partial flow.

Conveniently, the gas in the partial gas flow is heated to a given temperature, e.g. 5° C., above the temperature of the remainder of the gas, thereby enabling the means required for modifying the output signal of the output signal generating means to be simplified.

As before mentioned the invention also relates to a device for determining the relative humidity of a highly moist gas, particularly air exiting from a wood-drying apparatus, of the type comprising a humidity sensing arrangement having a capacitive sensor which is exposed to the gas and the capacitance of which varies with changes in the relative humidity of said gas, and further having means for generating an output signal proportional to the prevailing capacitance of said capacitive sensor, which device for the purpose of achieving the object of the invention is characterized by means for defining a partial flow of said gas; means for heating said partial flow, said sensor being arranged in the path of the heated partial flow so as to be exposed thereto; and means for modifying the output signal of said output signal generating means in correspondence with the extent to which said partial flow has been heated.

Conveniently, there is arranged in the partial gas flow, upstream of the capacitive sensor, an adjustable heat source which is arranged to co-act with control means for regulating the heat source such that the gas in the partial gas-flow is heated to a given temperature above the temperature of the remaining gas.

Additional features of and advantages afforded by the invention will be apparent from the following description of an embodiment made hereinafter with reference to the accompanying schematic drawing.

Figure 1:
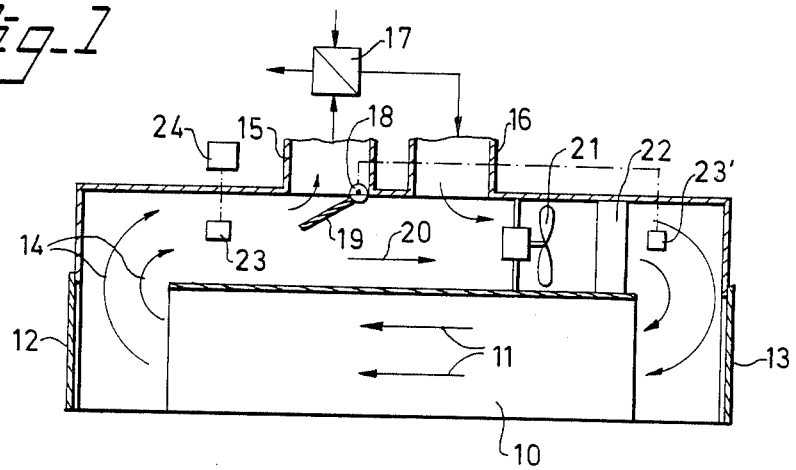
FIG. 1 is a schematic axial sectional view of a progressive timber kiln.

In FIG. 1 there is shown a progressive kiln having a drying tunnel 10 through which gas flows in the fashion indicated by arrows 11. The reference numerals 12 and 13 identify respective doors through which stacks of wood to be dried are introduced into the tunnel 10 and removed therefrom, after having passed therethrough. The exhaust air, which has passed through the tunnel and which is extremely moist, is re-routed in the manner indicated by arrows 14. Part of the exhaust air is discharged through a duct 15 and is replaced with drier air, which is taken in through a duct 16 subsequent to being subjected to heat-exchange with the discharged exhaust air in a heat-exchanger 17. The amount of exhaust air discharged through the duct 15 is determined by a valve 19, which can be adjusted by means of a regulatable valve-setting motor 18. The remainder of the exhaust air is recycled by means of a fan 21, in the manner indicated by arrow 20, and prior to entering the tunnel 10 at the outlet end thereof for dried wood is heated in a heater 22, together with the air entering through duct 16.

The reference 23 identifies a device for use when determining the relative humidity of the exiting or exhaust air, the values obtained being indicated and registered in a device 24 and used to determine the rate at which the wood is charged to the kiln and removed therefrom. The reference 23' identifies a similar device for use when measuring the relative humidity of the ingoing air, the values obtained being converted in means not shown to a setting-motor control signal of such nature as to ensure that the amount of exhaust air discharged through the duct 15 is commensurate with the amount required to maintain the drying air at the desired relative humidity.

Figure 2:
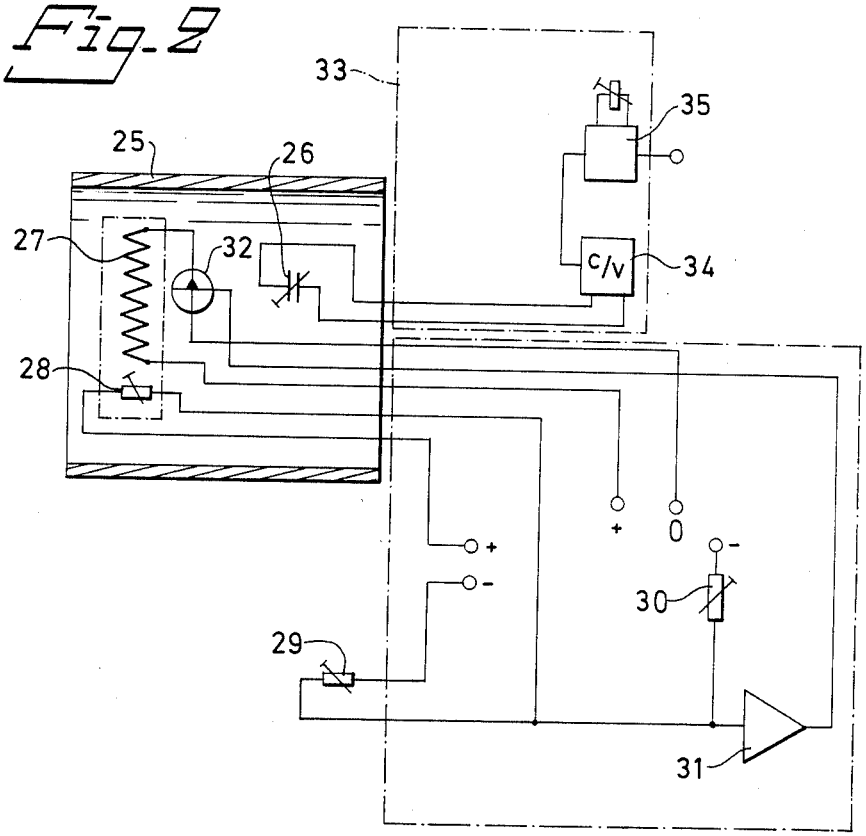
FIG. 2 illustrates schematically an arrangement for measuring the relative humidity of a flowing gas, particularly the gas exiting from the kiln of FIG. 1.

FIG. 2 illustrates schematically a suitable embodiment of the device 23 for determining the relative humidity of the air exiting from the kiln shown in FIG. 1. This device includes means for defining a partial flow of said exiting air in the form of a pipe 25 through which a relatively small part of the exhaust air flows from left to right in FIG. 2. Arranged in the downstream end of the pipe 25 is a capacitive sensor 26, which is exposed to the partial flow of exhaust air passing through pipe 25. Arranged in the pipe, upstream of the sensor 26 is an adjustable electrical heat source 27 which heats the moist air to which the sensor 26 is exposed. The device further includes a first temperature sensing device or thermistor 28, which is also exposed to the moist air, and a second temperature-sensing device 29, which is exposed to that remaining part of the moist exhaust air which is not heated by the heat source 27, said device 29 being inversely connected to the device 28. The temperature-sensing devices 28,29 are connected, together with an adjustable set-point selector 30, to the input of an inverting amplifier 31, the output of which is connected to the base of a transistor 32, which is connected in series with the electrical heat source 27. Thus, with the aid of the set-point selector 30 it is possible to set a predetermined constant temperature differential between the heated and non-heated exhaust air.

The capacitive sensor 26 is connected to an arrangement 33 which includes a circuit 34 for producing a voltage signal corresponding to the capacitance of the sensor 26. In turn, the circuit 34 is connected to a calibratable modifying circuit 35, by means of which the output signal from circuit 34 is modified in correspondence with the extent to which the partial flow of air passing through the pipe 25 is heated, said extent being set by means of the set-point selector 30. Thus, the circuit 35 produces an output signal which is proportional to the relative humidity of the not-heated exhaust air and which can be used to control the setting of the valve 17 in a known manner, so as to maintain an optimum drying-air composition. Any inaccuracies of the sensor 26 can also be compensated for by calibrating the circuit 25.

The invention is not restricted to the above described embodiment illustrated in the drawing, but can be realized in many different ways within the scope of the inventive concept as defined in the claims. Primarily, the invention is intended for use in situations such as those in which a relative humidity in excess of 80–90can occur, in which case the partial flow of gas to which the capacitive sensor is exposed may, to advantage, be heated to such an extent that the relative humidity of the heated partial air flow reaches to about 50%.

I claim:

1. A method for use when determining the relative humidity of a highly moist gas, particularly air exiting from a wood-drying apparatus, in which method there is used a humidity sensing arrangement having a capacitive sensor exposed to the gas and the capacitance of which varies with changes in the relative humidity of said gas, and further having output signal generating means for generating an output signal proportional to te prevailing capacitance of said capacitive sensor, said method comprising:

defining a partial flow of said highly moist gas;

lowering the relative humidity of said partial flow by heating said partial flow;

exposing the capacitive sensor to the heated partial flow of reduced relative humidity; and modifying the output signal of said output signal generating means in correspondence with the extent to which said partial flow has been heated.

2. A method according to claim 1, further comprising heating the gas in said partial flow to a given temperature above the temperature of the remaining gas.

3. A device for use when determining the relative humidity of a highly moist gas, particularly air exiting from a wood-drying apparatus, said device comprising:

a humidity sensing arrangement having a capacitive sensor exposed to the gas and the capacitance of which varies with changes in the relative humidity of said gas, and further having output signal generating means for generating an output signal proportional to the prevailing capacitance of said capacitive sensor;

means for defining a partial flow of said gas;

means for lowering the relative humidity of said partial flow by heating said partial flow, said capacitive sensor being arranged in the path of the heated partial flow of reduced relative humidity so as to be exposed thereto; and means for modifying the output signal of said output signal generating means in correspondence with the extent to which said partial flow has been heated.

4. A device according to claim 3, wherein there is arranged in the partial gas flow, upstream of the capacitive sensor, an adjustable heat source arranged to co-act with control means for regulating the heat source such that the gas in the partial gas-flow is heated to a given temperature above the temperature of the remaining gas.

5. A method for use when determining the relative humidity of a highly moist gas, where the relative humidity of the gas may be in excess of 80%, particularly air exiting from a wood-drying apparatus, in which method there is used a humidity sensing arrangement having a capacitive sensor exposed to the gas and the capacitance of which varies which changes in the relative humidity of said gas, and further having output signal means for generating an output signal proportional to the prevailing capacitance of said capacitive sensor, said method comprising:

defining a partial flow of said highly moist gas;

lowering the relative humidity of the partial flow to about 50% by heating said partial flow;

exposing the capacitive sensor to the heated partial flow of reduced relative humidity; and modifying the output signal of said output signal generating means in correspondence with the extent to which said partial flow has been heated.

* * * * *